US010617207B2

(12) United States Patent
Hsiao

(10) Patent No.: US 10,617,207 B2
(45) Date of Patent: Apr. 14, 2020

(54) TRANSFORMABLE TABLE

(71) Applicant: KELLY INTERNATIONAL CORP., Taipei (TW)

(72) Inventor: Shu Chen Hsiao, Taipei (TW)

(73) Assignee: KELLY INTERNATIONAL CORP., Taipei (TW)

( * ) Notice: Subject to any disclaimer, the term of this patent is extended or adjusted under 35 U.S.C. 154(b) by 0 days.

(21) Appl. No.: 16/379,540

(22) Filed: Apr. 9, 2019

(65) Prior Publication Data

US 2020/0069053 A1 Mar. 5, 2020

(30) Foreign Application Priority Data

Aug. 31, 2018 (TW) ..... 107130474 A

(51) Int. Cl.

| | |
|---|---|
| ***A47B 85/06*** | (2006.01) |
| ***A47B 5/04*** | (2006.01) |
| ***A47B 5/00*** | (2006.01) |
| ***A47B 13/00*** | (2006.01) |
| *E04B 2/74* | (2006.01) |

(52) U.S. Cl.

CPC ..... *A47B 85/06* (2013.01); *A47B 5/006* (2013.01); *A47B 5/04* (2013.01); *A47B 13/003* (2013.01); *A47B 2013/006* (2013.01); *E04B 2002/7483* (2013.01)

(58) Field of Classification Search

CPC .. A47B 5/006; A47B 5/04; A47B 5/06; A47B 85/00

USPC ..... 108/15, 13, 115

See application file for complete search history.

(56) References Cited

U.S. PATENT DOCUMENTS

| | | | | | |
|---|---|---|---|---|---|
| 348,706 | A * | 9/1886 | Weiner | A47B 19/08 | 108/115 |
| 786,526 | A * | 4/1905 | Sollom | A47B 85/06 | 108/15 |
| 1,402,929 | A * | 1/1922 | Herpst | A47B 43/00 | 108/116 |
| 2,598,128 | A * | 5/1952 | Liechty | A47B 19/08 | 108/13 |
| 4,248,161 | A * | 2/1981 | Adair | A47B 27/02 | 108/6 |
| 5,078,056 | A * | 1/1992 | McCauley | A47B 3/00 | 108/115 |

(Continued)

FOREIGN PATENT DOCUMENTS

| | | |
|---|---|---|
| CN | 103462375 A | 12/2013 |
| TW | M510671 U | 10/2015 |

OTHER PUBLICATIONS

Taiwan Patent Office, Office Action, Patent Application Serial No. TW107130474, dated Jan. 9, 2019, Taiwan.

*Primary Examiner* — Jose V Chen

(74) *Attorney, Agent, or Firm* — Rabin & Berdo, P.C.

(57) ABSTRACT

A transformable table includes a base, a transformable platform mounted on the base, a lifting mechanism that drives the transformable platform to move up and down, and an interlocking member that draws the transformable platform to pivot. Thereby, the up and down movements of the lifting mechanism can make the transformable platform pivot accordingly so that the surface of the transformable platform can be selectively posed at different angles required by different applications, thereby allowing the transformable table to be used with versatility.

15 Claims, 8 Drawing Sheets

(56) References Cited

U.S. PATENT DOCUMENTS

| | | | | |
|---|---|---|---|---|
| 6,192,808 | B1 * | 2/2001 | Bue | A47B 3/0911 108/1 |
| 6,354,227 | B1 * | 3/2002 | Feldpausch | A47B 37/02 108/10 |
| 7,614,351 | B2 * | 11/2009 | Piretti | A47B 3/0815 108/1 |
| 7,631,604 | B2 * | 12/2009 | Huang | A47B 3/08 108/115 |
| 7,712,422 | B2 * | 5/2010 | Bue | A47B 3/00 108/115 |
| 7,836,833 | B2 * | 11/2010 | Kumazawa | A47B 3/0815 108/115 |
| 8,196,529 | B2 * | 6/2012 | Witkowski | A47B 3/083 108/115 |
| 8,539,888 | B2 * | 9/2013 | Hernandez | A47B 85/06 108/115 |
| 8,539,889 | B1 * | 9/2013 | Khalaf Allah | A47B 85/06 108/115 |
| 8,789,474 | B2 * | 7/2014 | Kim | A47B 41/02 100/138 |
| 9,615,678 | B1 * | 4/2017 | Lindblom | A47F 5/0087 |
| 9,723,919 | B1 * | 8/2017 | Randolph | A47B 21/04 |
| 2003/0056699 | A1 * | 3/2003 | Malizia | A47B 3/00 108/115 |
| 2011/0017107 | A1 * | 1/2011 | Ko | A47B 3/0818 108/64 |
| 2015/0033990 | A1 * | 2/2015 | Yeager | A47B 85/06 108/15 |

* cited by examiner

TRANSFORMABLE TABLE

BACKGROUND OF THE INVENTION

1. Technical Field

The present invention relates to tables, and more particularly to a transformable table that is adaptable to various applications.

2. Description of Related Art

Good interior layouts in environments such as sites for working, meeting, networking and learning contribute to desirable results. However, with the development of technologies and social living, the traditional equipment and interior layouts become insufficient to meet the increasingly diverse demands of space utilization.

Taking an office for example, the conventional furnishings usually depend on fixed facilities. For adapting the office to other activities (such as meetings of different sizes, seeing visitors, or having discussions), corresponding facilities have to be prepared and stored. In the modern era when web-based technologies have been rapidly developed, people interact and work in increasingly changing ways, and the incidental needs featuring high mobility amplify the limitations of the conventional furnishings. The dilemma of saving resources but risking efficiency or preparing well yet causing waste thus exists.

In view of the trend of social development, it is desired to make furniture as versatile as possible so as to satisfy diverse user needs and maximize usage of interior space. The inventor thus has paid great efforts to address problems about limited living spaces and thus accomplished the present invention.

BRIEF SUMMARY OF THE INVENTION

The primary objective of the present invention is to provide a transformable, versatile table, which can have its profile changed according to user needs, thereby catering to various interior layouts and satisfying diverse user needs.

To achieve the foregoing objective, the present invention adopts the following technical means and structural features. Therein, the disclosed transformable table comprises a base, a transformable platform, a lifting mechanism, and an interlocking member. The transformable platform is mounted on the base and defines a flat surface. With a platform pivot extending across its middle part, the transformable platform can pivot against the platform pivot. The transformable platform has its part at one side of the platform pivot defined as a first part herein. The lifting mechanism connects the platform pivot to the base, so as to allow the platform pivot to move between an upper position and a lower position. The interlocking member connects the first part to the base, and can draw the first part to make the transformable platform pivot as the platform pivot moves. When the platform pivot stops moving, the surface of the transformable platform has pivoted to a predetermined angle. Thereby, the up and down movements of the lifting mechanism can make the transformable platform pivot accordingly so that the surface of the transformable platform can be selectively posed at different angles required by different applications, thereby allowing the transformable table to be used as a normal table with a horizontal tabletop, a drawing table with an inclined tabletop, a lectern, an upstanding screen, or a bulletin board.

Preferably, when the platform pivot is in the lower position, the surface of the transformable platform has pivoted to a substantially horizontal angle, and when the platform pivot is in the upper position, the surface of the transformable platform has pivoted to an upstanding posture where it is substantially at an upstanding vertical angle, and the interlocking member and the transformable platform are coplanar without overlapping each other. When lifting mechanism makes the platform pivot go down to the lower position, the transformable platform is lowered and the surface is substantially at a horizontal angle, so it can be used as a normal table. When the lifting mechanism makes the platform pivot go upward, the transformable platform is drawn upward by the interlocking member. When the platform pivot arrives at the upper position, the transformable platform is lifted and the surface has pivoted to a substantially upstanding vertical angle, so that the transformable platform and the interlocking member become coplanar without overlapping each other, and jointly form an upstanding single-layer board to be used an indoor upstanding facility, such as a screen or a bulletin board. Additionally, the base are further provided with plural casters for easy deployment.

Based on the foregoing configuration, the transformable table further comprises a locking mechanism for limiting the lifting and lowering of the lifting mechanism. Therein, the locking mechanism at least serves to releasably lock the lifting mechanism in the lower position.

Based on the foregoing configuration, the base comprises a fixed first brace, and the lifting mechanism comprises a second brace connected to the first brace so that the second brace can move with respect to and along the first brace. The combination of the first brace and the second brace provides a supportive telescopic pole. Furthermore, the platform pivot is connected to the second braces, and moves between the upper position and the lower position with the second braces.

Based on the foregoing configuration, the lifting mechanism further comprises a extension driver whose two ends are connected to the first brace and the second brace, respectively, for driving the second brace to move against the first brace. Preferably, the extension driver is a gas lift that is extendable and provides an extension force, thereby making the lifting operation easier and more effortless.

Based on the foregoing configuration, the locking mechanism comprises a spring-loaded pull, a rope and a knob. The spring-loaded pull is installed on the first brace for releasably locking the second brace with respect to the first brace. The rope is connected between the knob and the spring-loaded pull. The knob is operable to drive the rope to unlock the spring-loaded pull. Therein, the second brace has a positioning hole corresponding at the lower position corresponding to the spring-loaded pull for the spring-loaded pull to releasably engage.

Based on the foregoing configuration, the base comprises two said first braces, and the lifting mechanism comprises two said second braces, so that the platform pivot has two ends thereof connected to the two second braces, respectively.

Based on the foregoing configuration, the interlocking member is a plate-shaped member located below the transformable platform. The interlocking member has its one side pivotally connected between the two first braces, and has its opposite side is linked to the first part of the transformable platform via at least one pivotal link.

Based on the foregoing configuration, the base further comprises a retaining plate located below the interlocking member, and the retaining plate is upstanding as it is connected between the two first braces.

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

DETAILED DESCRIPTION OF THE INVENTION

Figure 1:
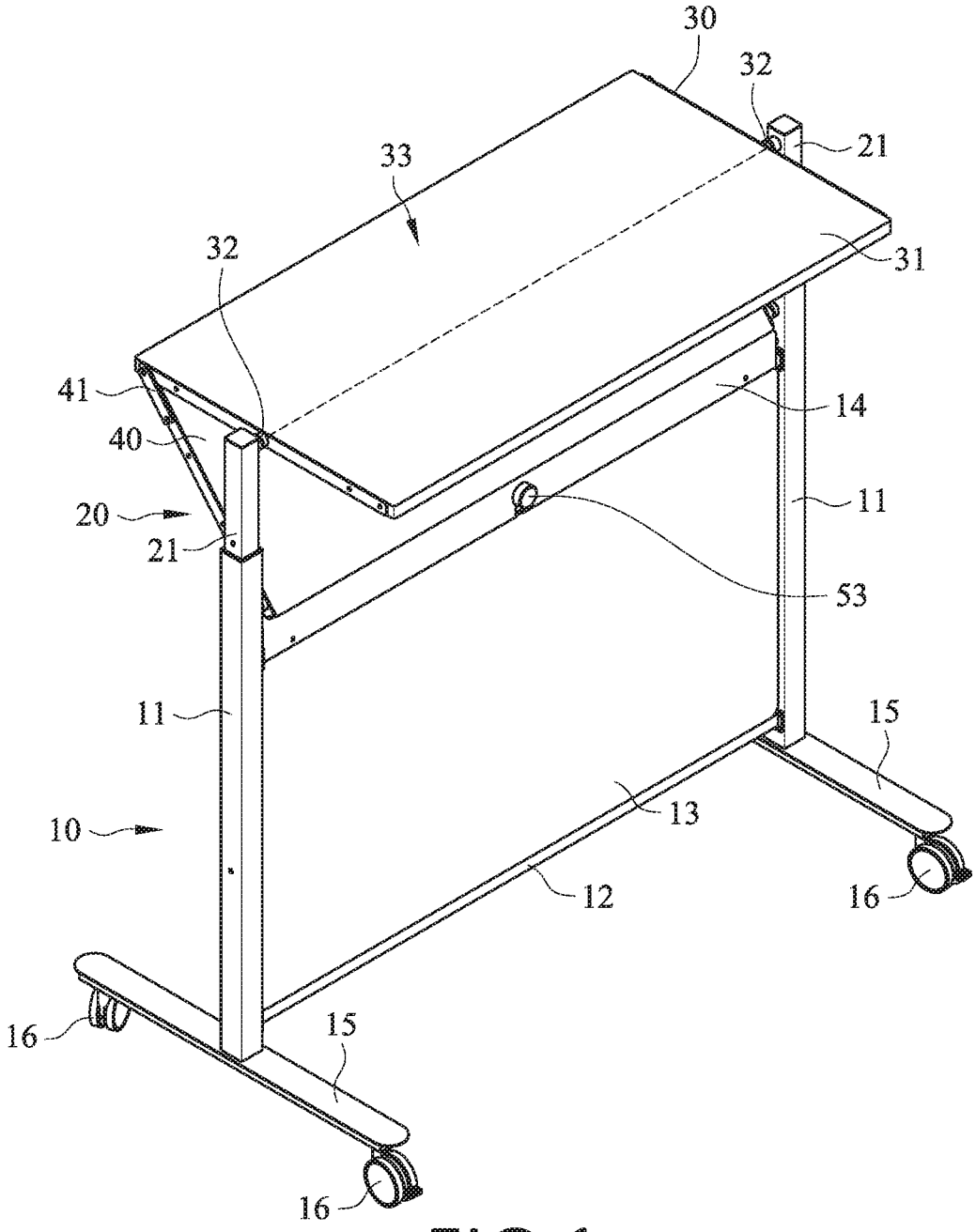
FIG. 1 is a perspective view of one preferred embodiment of the present invention, showing the transformable table in its lower position.
Figure 2:
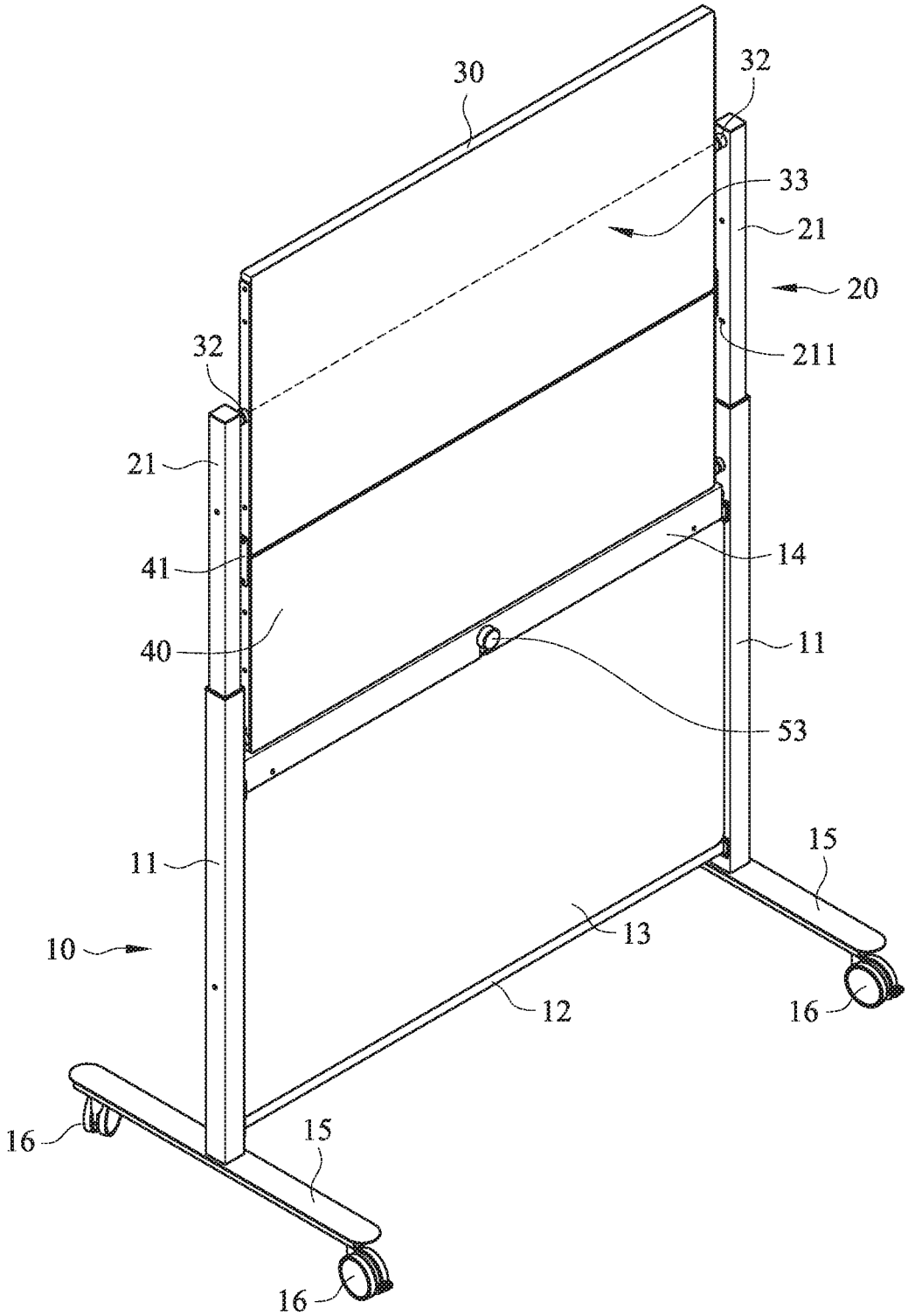
FIG. 2 is a perspective view of the embodiment, showing the transformable table in its upper position.
Figure 3:
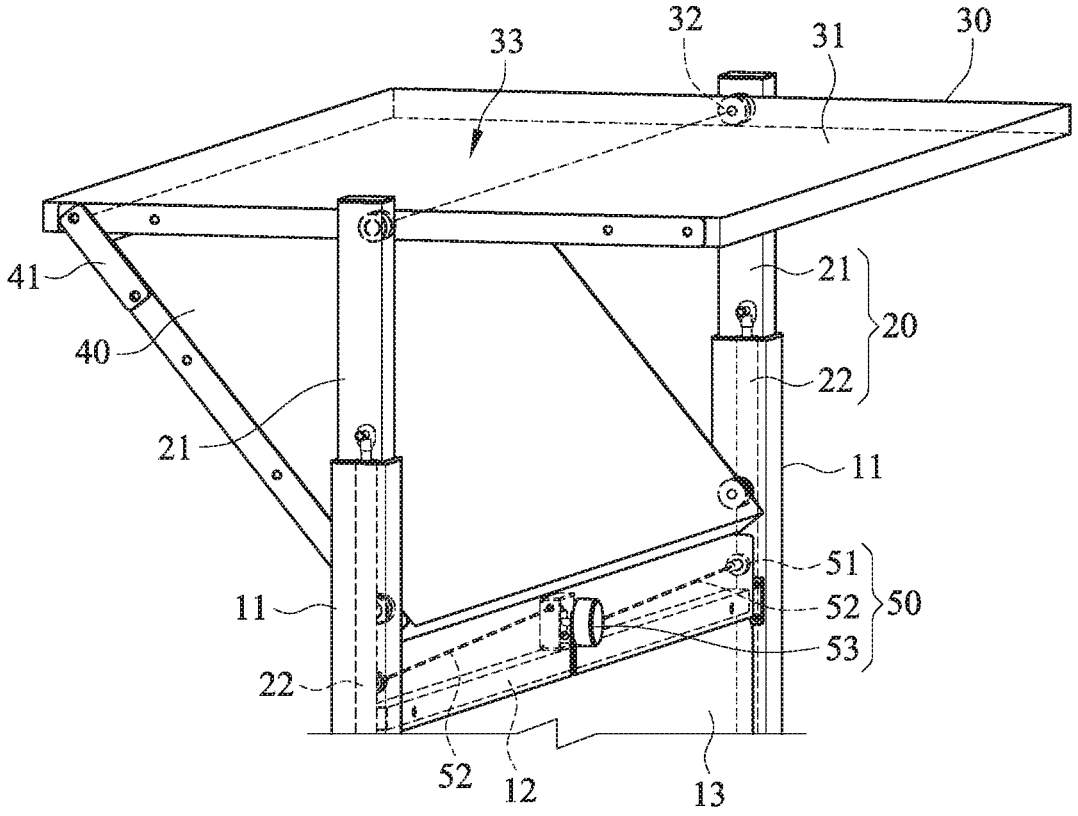
FIG. 3 is a perspective broken-open view of the embodiment.

Referring to FIG. 1 through FIG. 3, according to the present embodiment, a transformable table primarily has a base 10, a lifting mechanism 20, a transformable platform 30, an interlocking member 40 and a locking mechanism 50.

The base 10 is a fixed frame composed of plural supports, and is at the bottom provided with plural casters 16 for horizontal displacement. The lifting mechanism 20 is connected to the base 10 and a platform pivot 32 of the transformable platform 30, and is allowed to move up and down with respect to the base 10, so as to enable the platform pivot 32 to move between an upper position and a lower position. The transformable platform 30 moves up and down with the platform pivot 32, and has its part at one side of the platform pivot 32 defined as the first part 33 herein (e.g. the left part against the dotted line drawn across the platform pivot 32 in FIG. 1). The interlocking member 40 connects the first part 33 to the base 10, and works to draw the first part 33 to drive the transformable platform 30 to pivot as the transformable platform 30 moves up and down. In this way, the transformable platform 30 forms different angles when positioned at different heights, thereby satisfying various user needs. The locking mechanism 50 serves to releasably lock the lifting mechanism 20 and is operable to users.

In the present embodiment, the frame of the base 10 primarily comprises two bottom bars 15, two first braces 11, two beams 12, and a retaining plate 13. The two bottom bars 15 each has two casters 16. The two first braces 11 are vertically mounted on the bottom bars 15, respectively. The two beams 12 are connected between the two first braces 11 for maintaining the relative position between the two first braces 11. One of the beams 12 is located higher (as shown in FIG. 3), while the other beam 12 is located lower. The retaining plate 13 stands upright between the two beams 12 to provide partition. In addition, a casing 14 for receiving the locking mechanism 50 is located above the retaining plate 13.

Figure 4:
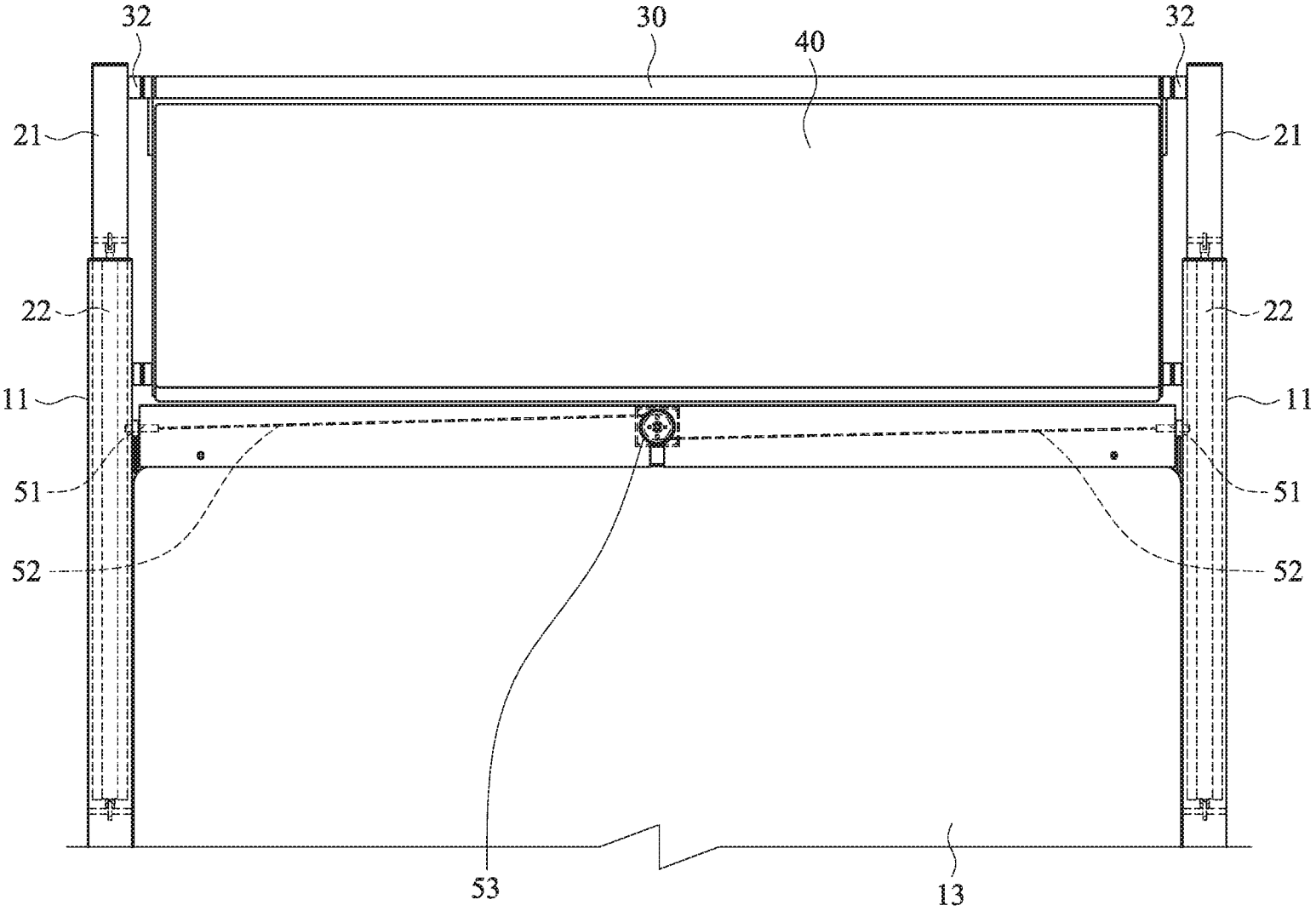
FIG. 4 is a front broken-open view of the embodiment.

The lifting mechanism 20 primarily has two second braces 21. The two second braces 21 are each combined with one said first brace 11 so as to form a telescopic pole, wherein each said second brace 21 can move up and down with respect to and along the corresponding first brace 11. Referring also to FIG. 4, the first brace 11 and the second brace 21 are hollow tubes that can be telescoped, and an extension driver 22 is provided therein. The extension driver 22 has its two ends fixed to the first brace 11 and the second brace 21, respectively, for driving the second brace 21 to move against the first brace 21. In a practical embodiment, the extension driver 22 is a gas lift that provides the required driving force.

The transformable platform 30 is supported by the base 10 and defines a flat surface 31. It is provided with the platform pivot 32 that extends transversely across its middle part, so that the transformable platform 30 can pivot against the platform pivot 32. The platform pivot 32 has its one side herein defined as a first part 33. The platform pivot 32 has its two ends each connected to one said second brace 21, so that it can move up and down with the second brace 21 between an upper position and a lower position.

The interlocking member 40 has a plate-like shape, and is located below the transformable platform 30, with its one side pivotally connected between the two first braces 11 and its opposite side pivotally connected to the ends of the first part 33. In the present embodiment, the interlocking member 40 has its opposite side equipped with two pivotal links 41 that are connected to the first part 33 of the transformable platform 30 at places near the ends. The two pivotal links 41 is driven by the up and down movements of the transformable platform 30, and draws the first part 33 to make the transformable platform 30 pivot correspondingly. When the transformable platform 30 stop moving vertically, or, when the platform pivot 32 stops moving, the transformable platform 30 stops at an angle it is posed at that time. In the present embodiment, when the transformable platform 30 and the platform pivot 32 is in their lower positions, the transformable platform 30 is lowered and the surface 31 has pivoted to a substantially horizontal angle, making it suitable for working as a tabletop (as shown in FIG. 1). When the transformable platform 30 and the platform pivot 32 are in their upper positions, the transformable platform 30 is lifted and the surface 31 pivots to an upstanding posture. At this time, the interlocking member 40 has pivoted to an upstanding posture, so that it is vertically aligned with and located between the transformable platform 30 and the retaining plate 13. In other words, the transformable platform 30, the interlocking member 40, and the retaining plate 13 are coplanar without overlapping each other are coplanar without overlapping each other, and jointly form an upstanding, single layer panel, which can be used as a screen or a bulletin board (as shown in FIG. 2). With the ability to change its profile, the transformable table can be used diversely.

Figure 5:
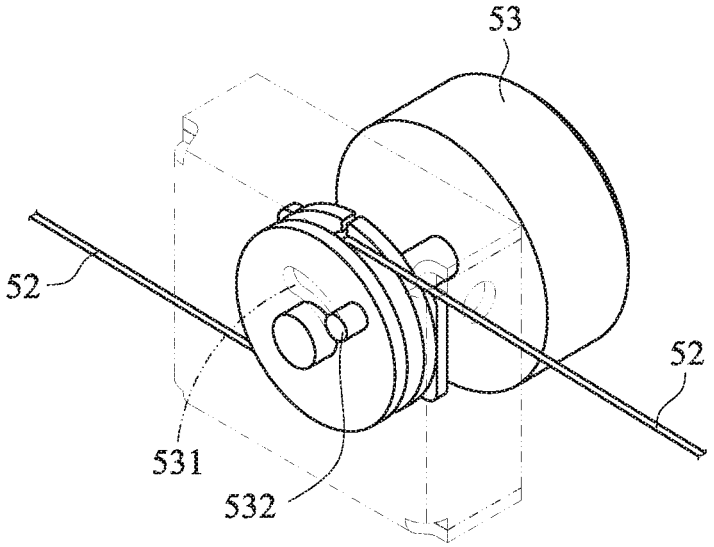
FIG. 5 is a schematic drawing illustrating the knob of the embodiment.
Figure 6:
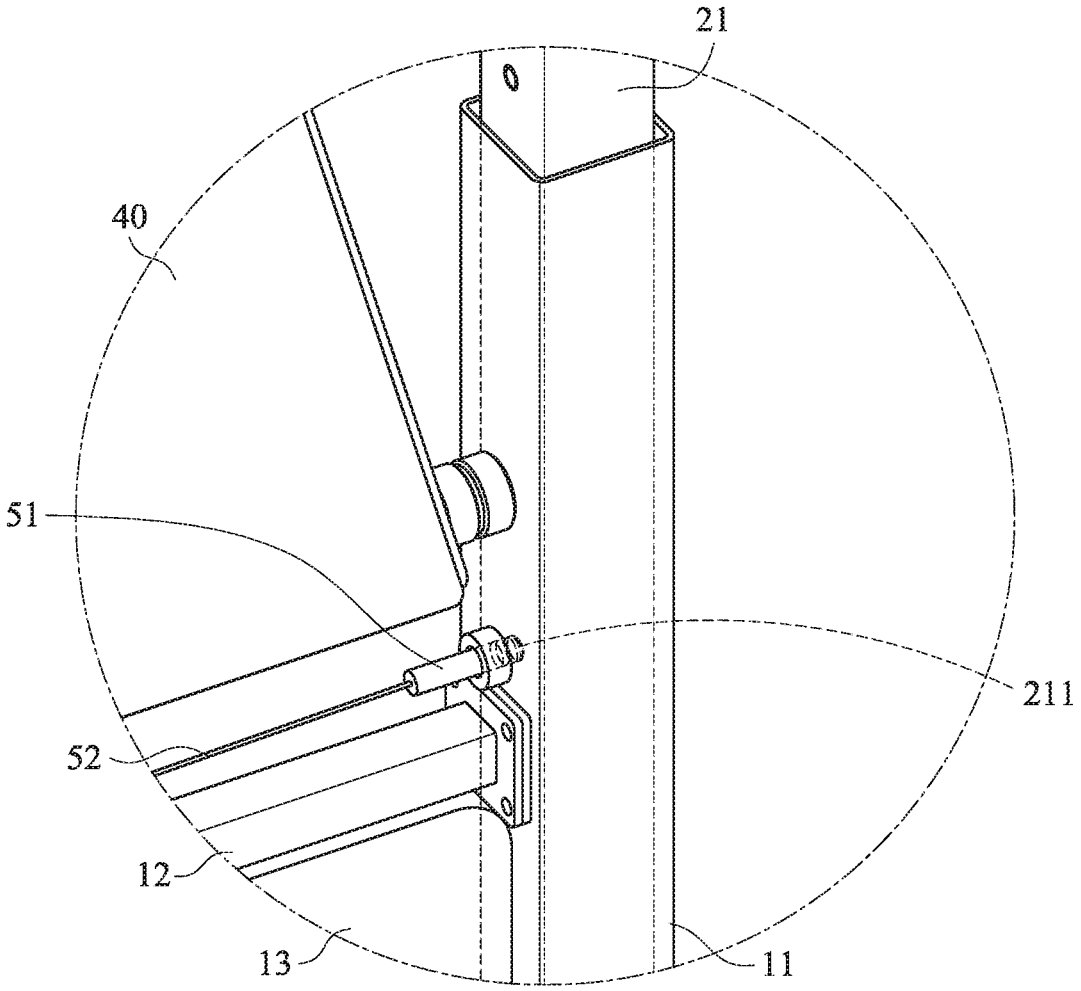
FIG. 6 is a local schematic drawing of the embodiment, illustrating the spring-loaded pull.

Referring to FIG. 5 and FIG. 6 together, the locking mechanism 50 primarily comprises two spring-loaded pulls 51, two ropes 52, and a knob 53. Each of the spring-loaded pulls 51 is installed on a corresponding said first brace 11, and releasably locks the second brace 21 with respect to the first brace 11. When the bolt portion of the spring-loaded pull 51 is inserted into the positioning hole 211 of the second brace 21, the spring-loaded pull 51 now in its locked state can keep the relative position between the second brace 21 and the first brace 11. When the bolt portion of the spring-loaded pull 51 is pulled out from the positioning hole 211 of the second brace 21, the foregoing locked state is released (unlocked). At this time, the second brace 21 is allowed to move with respect to the first brace 11, until the positioning hole 211 of the second brace 21 is moved to a site it is aligned with the spring-loaded pull 51 at which site the spring-loaded pull 51 automatically engages it and the locked state is recovered. In the present embodiment, the second brace 21 has at least a positioning hole such formed that when it is in the lower position, the positioning hole corresponds to the spring-loaded pull 51. Each of the two ropes 52 is connected to one said corresponding spring-loaded pull 51 and the knob 53, so that the ropes 52 can be controlled by the knob 53 to pull and release the spring-loaded pulls 51, thereby allowing up and down movements. The knob 53 comprises a fixed part having a retaining recess 531 and a rotatable part having a protrusion 532 that limits how much the knob 53 can rotated when operated. The two ropes 52 are connected to the rotatable part of the knob 53, respectively. When the knob 53 rotates, it drives the two ropes 52 to pull the spring-loaded pull 51 and dismisses the locked state.

In a practical embodiment, the second brace 21 may be provided with plural positioning holes 211 for the spring-loaded pull 51 to selectively engage. The vertical position of the second braces 21 depending on the selected positioning holes 211 determines the angle of the surface 31 of the transformable platform 30 after its pivotal movement. By selecting different positioning holes 211, the transformable platform 30 can be posed differently for various applications.

Figure 7:
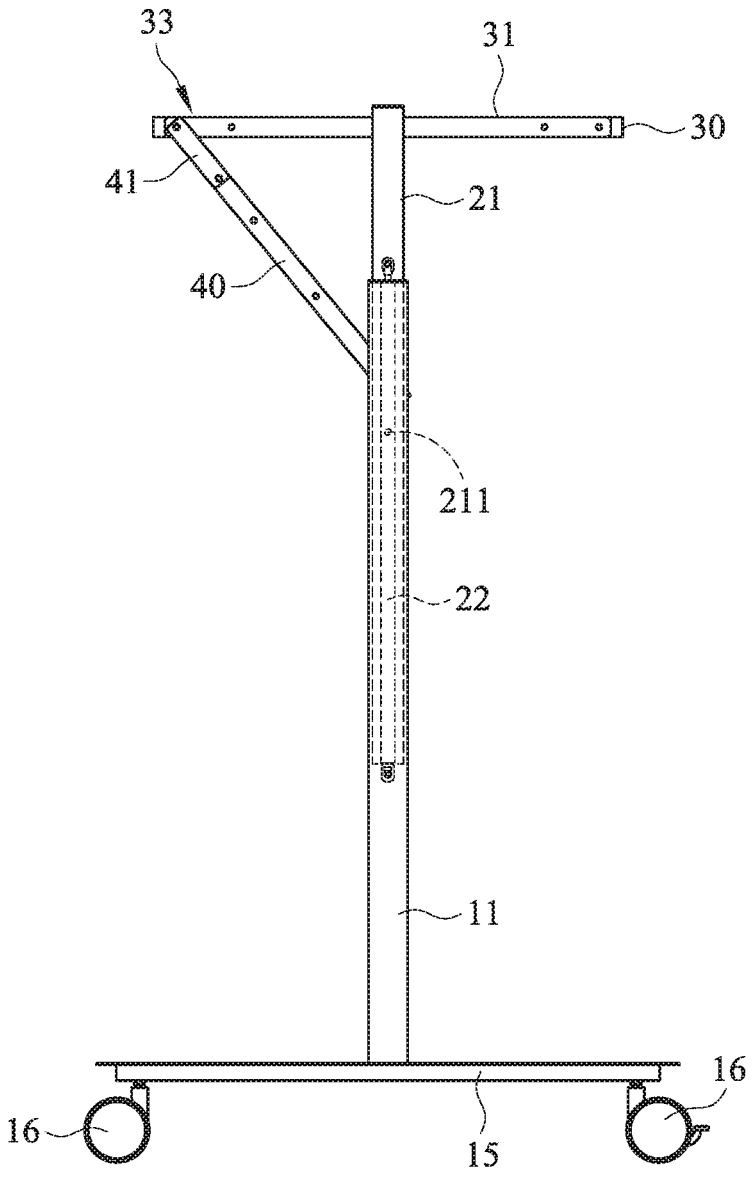
FIG. 7 is a side view of the embodiment, showing the transformable table in its lower position.
Figure 8:
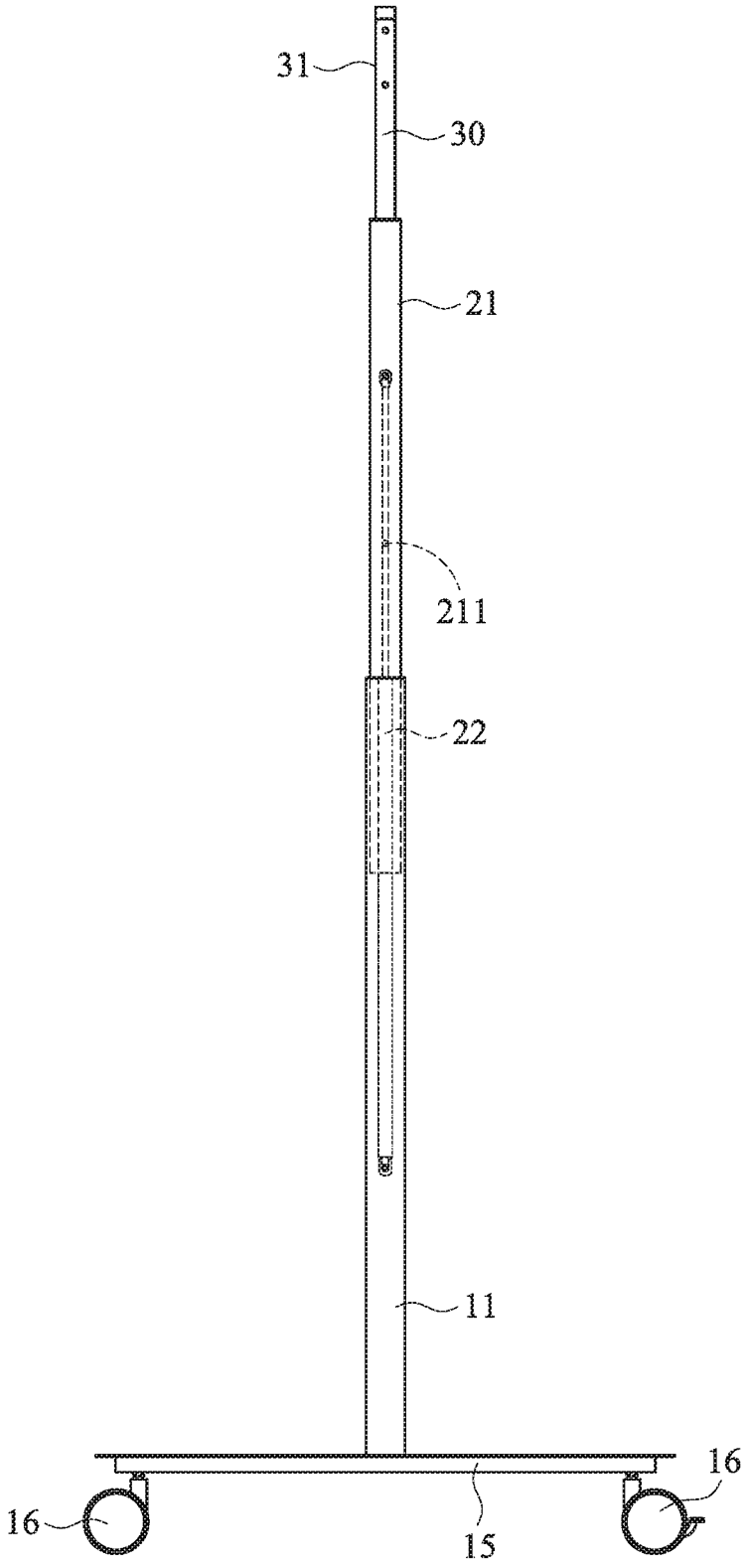
FIG. 8 is a side view of the embodiment, showing the transformable table in its upper position.

Referring to FIG. 7 and FIG. 8 together, in the lower position, the spring-loaded pulls 51 of the locking mechanism 50 are inserted into the positioning holes 211 of the second brace 21 to maintain the locked state. At this time, the surface 31 of the transformable platform 30 has pivoted to a substantially horizontal angle (as shown in FIG. 1 and FIG. 7) and may be used as a tabletop. When transformation is desired, it can be easily achieved by rotating the knob 53, which then drives the ropes 52 to pull the spring-loaded pull 51 and unlock the lifting mechanism 20. To this point, the extension driver 22 (i.e. the gas lift) can act to automatically raise the second brace 21 from the first brace 11, until they reach the upper position (as shown in FIG. 2 and FIG. 8). Meanwhile, the second braces 21 drive the transformable platform 30 to move upward, and the transformable platform 30 is drawn by the interlocking member 40 to pivot against the platform pivot 32. When the surface 31 of the transformable platform 30 pivots to the upstanding posture, the transformation is completed, and the transformable table can now be used as a screen or a bulletin board. For turning it back to a table, a user can push the transformable platform 30 downward with a little effort that is sufficient to overcome the acting force of the extension driver 22 so that the lifting mechanism 20 can move downward. When the lifting mechanism 20 arrives at the lower position, the spring-loaded pulls 51 automatically engage the positioning holes 211 of the second brace 21 to lock the surface 31 of the transformable platform 30 at its horizontal position to be used as a tabletop (as shown in FIG. 1 and FIG. 7).

To sum up, the disclosed transformable table is structurally simple, easy to operate and versatile in use, making it novel, inventive and patent-worthy. The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A transformable table, comprising:

a base, having two vertical first braces fixedly mounted thereon;

a transformable platform, being located above the base and defining a flat surface, the transformable platform having a platform pivot that extends transversely across a middle part so that the transformable platform is allowed to pivot against the platform pivot, and the transformable platform having a first part located at one side of the platform pivot;

a lifting mechanism, comprising two second braces connected to the two first braces, respectively, so that each said second brace is allowed to move with respect to and along the corresponding first brace, wherein the platform pivot has two ends connected the two second braces, respectively, so that the platform pivot is allowed to move between an upper position and a lower position with the two second braces; and an interlocking member, having one side pivotally connected between the two first braces and having an opposite side pivotally connected to the first part of the transformable platform, wherein the interlocking member is configured to draw the first part to make the transformable platform pivot as the platform pivot moves, and when the platform pivot stops moving, the surface of the transformable platform has stopped pivoting;

whereby, when the platform pivot has moved to the upper position, the surface of the transformable platform has pivoted to be substantially vertical, so that the interlocking member and the transformable platform are coplanar without overlapping each other.

2. The transformable table of claim 1, wherein when the platform pivot is in the lower position, the surface of the transformable platform has pivoted to be substantially horizontal.

3. The transformable table of claim 1, further comprising a locking mechanism configured to releasably lock the lifting mechanism in the lower position.

4. The transformable table of claim 3, wherein the interlocking member is a plate-shaped member, and the interlocking member is connected to the first part of the transformable platform via at least one pivotal link.

5. The transformable table of claim 4, wherein the base further comprises a retaining plate located below the interlocking member, and the retaining plate is configurable to be vertical between the two first braces, so that when the platform pivot is in the upper position, the transformable platform, the interlocking member, and the retaining plate are coplanar without overlapping each other.

6. The transformable table of claim 3, wherein the lifting mechanism further comprises an extension driver having two ends connected to the first brace and the second brace, respectively, for driving the second brace to move with respect to the first brace.

7. The transformable table of claim 6, wherein the extension driver is a gas lift that is extendable.

8. The transformable table of claim 7, wherein the interlocking member is a plate-shaped member, and the interlocking member is connected to the first part of the transformable platform via at least one pivotal link.

9. The transformable table of claim 8, wherein the base further comprises a retaining plate located below the interlocking member, and the retaining plate is configurable to be vertical between the two first braces, so that when the platform pivot is in the upper position, the transformable platform, the interlocking member, and the retaining plate are coplanar without overlapping each other.

10. The transformable table of claim 6, wherein the interlocking member is a plate-shaped member, and the interlocking member is connected to the first part of the transformable platform via at least one pivotal link.

11. The transformable table of claim 10, wherein the base further comprises a retaining plate located below the interlocking member, and the retaining plate is configurable to be vertical between the two first braces, so that when the platform pivot is in the upper position, the transformable platform, the interlocking member, and the retaining plate are coplanar without overlapping each other.

12. The transformable table of claim 6, wherein the locking mechanism comprises a spring-loaded pull, a rope connected to the spring-loaded pull, and a knob rotatably connected to the rope, in which the spring-loaded pull is installed on the first brace for releasably locking the second brace with respect to the first brace, the knob being operable to pull the rope to release the spring-loaded pull.

13. The transformable table of claim 12, wherein the interlocking member is a plate-shaped member, and the interlocking member is connected to the first part of the transformable platform via at least one pivotal link.

14. The transformable table of claim 13, wherein the base further comprises a retaining plate located below the interlocking member, and the retaining plate is configurable to be vertical between the two first braces, so that when the platform pivot is in the upper position, the transformable platform, the interlocking member, and the retaining plate are coplanar without overlapping each other.

15. The transformable table of claim 1, wherein a bottom of the base has a plurality of casters.

* * * * *